US006176749B1

(12) United States Patent
Kato

(10) Patent No.: US 6,176,749 B1
(45) Date of Patent: Jan. 23, 2001

(54) MOUNTING STRUCTURE FOR WATER JET PUMP OF PERSONAL WATERCRAFT

(75) Inventor: Hironori Kato, Hyogo (JP)

(73) Assignee: Kawasaki Jukogyo Kabushiki Kaisha, Hyogo (JP)

( * ) Notice: Under 35 U.S.C. 154(b), the term of this patent shall be extended for 0 days.

(21) Appl. No.: 09/415,288

(22) Filed: Oct. 8, 1999

(30) Foreign Application Priority Data

Oct. 23, 1998 (JP) ..... 10-302743

(51) Int. Cl.[7] ..... B63H 11/00
(52) U.S. Cl. ..... 440/38; 440/112
(58) Field of Search ..... 440/38, 111, 112

(56) References Cited

U.S. PATENT DOCUMENTS 2,977,923 * 4/1961 Bergstedt ..... 440/112
3,204,598 * 9/1965 Sharp ..... 440/112
4,925,408 * 5/1990 Webb et al. ..... 440/38

FOREIGN PATENT DOCUMENTS 8-104287 4/1996 (JP) .

* cited by examiner

*Primary Examiner*—Stephen Avila
(74) *Attorney, Agent, or Firm*—Marshall, O'Toole, Gerstein, Murray & Borun

(57) ABSTRACT

A mounting structure for a water jet pump of a personal watercraft which includes a vertical wall 5 formed at the rear end of a water intake duct to form a pump mounting space 6, a pump bracket 8 fitted with an inlet of the water jet pump 7 and having a connecting surface 15 to sealingly connect to the vertical wall 5. A sealant recess 15*b* for accommodating a non-solid sealant S such as a silicon gel, is formed in the connecting surface 15 of the pump bracket 8, to enhance the air and water sealing quality between the connecting surfaces of the pump bracket 8 and the vertical wall 5.

4 Claims, 5 Drawing Sheets

MOUNTING STRUCTURE FOR WATER JET PUMP OF PERSONAL WATERCRAFT

The present invention relates to a mounting structure for a water jet pump of a watercraft, and more particularly to a mounting structure for mounting a water jet pump in the bottom portion of the watercraft, in which a vertical wall is formed in a hull at the rear end of a water intake duct to form a pump mounting space, and a pump bracket fitted to the inlet of the water jet pump is sealingly connected to the vertical wall.

BACKGROUND OF THE INVENTION

A personal watercraft is propelled by a water jet pump designed to draw water (including sea water) through a water intake opening formed in the bottom of the watercraft, and to pressurize and accelerate the water to eject rearwardly through an ejecting nozzle formed at the rear of the pump for propelling the watercraft forward.

A certain type of personal watercraft includes, a water intake duct which extends diagonally upward and rearward in the center of the rear portion of a hull that constitutes the lower portion of the watercraft body, a vertical wall connected to the rear end of the duct to form a pump mounting space on the rear of the vertical wall, and a pump bracket fitted to the inlet of the water jet pump connected to the vertical wall.

For connecting the pump bracket to the vertical wall formed in the hull, in this structure, a sealing element is inserted in a gap formed between the connecting surfaces of the pump bracket and the vertical wall.

There is another sealing structure proposed for holding cables which penetrate the hull such as an operating cable for water jet pump and the like, and for joint elements holding pipes which penetrate the hull such as a bilge pipe connected to a bilge pump or a cooling water pipe connected to the engine, which holders and joint elements are directly and separately secured to the hull by an adhesive to seal the penetrated portion of the hull (see Japanese Laid-Open Patent Publication No. Hei 8-104287).

In the sealing structure connecting the pump bracket fitted to the inlet of the water jet pump to the vertical wall formed in the hull, it is sometimes difficult to insert the sealing element into the gap formed between connecting surfaces of the pump bracket and the vertical wall.

Moreover, the above structure of employing the sealing element between connecting surfaces of the hull and pump bracket, there remains a possibility of causing a small amount of leakage of water into the body of the watercraft or leakage of air into the pump, due to an insufficient sealing function of the sealing element between the connecting surfaces.

Separate sealing of holders and joint elements of the above prior structure increases complexity in design which requires a number of steps in the pump mounting operation.

SUMMARY OF THE INVENTION

Therefore, an object of the present invention is to provide a mounting structure for mounting a water jet pump of the personal watercraft, wherein a non-solid sealant is accommodated between the connecting surfaces of the vertical wall and the pump bracket ensuring sufficient and long lasting sealing effect of the connecting surfaces to prevent air and water leakage between the connecting surfaces.

The present invention provides a mounting structure for a water jet pump of a personal watercraft, comprising a vertical wall formed in a hull at the rear end of a water intake duct to form a pump mounting space, a pump bracket fitted with an inlet of a water jet pump mounted on the bottom of the watercraft, the pump bracket having a connecting surface to be connected to the vertical wall, the connecting surface having a sealant recess formed to accommodate a non-solid sealant leaving a peripheral connecting surface along the periphery of the connecting surface.

Prior to the mounting of the pump bracket to the vertical wall formed in the hull, the non-solid sealant is applied to the entire connecting surface of the pump bracket and the sealant is made to settle in the sealant recess. Then, by simply abutting the connecting surface of the pump bracket to the vertical wall, the sealant is uniformly accommodated across the entire connecting surface of the pump bracket, thus, the operation for sealing between the hull and the pump bracket is simplified thereby eliminating special care. Moreover, by the sealing structure in-which non-solid sealant is accommodated between connecting surfaces of the hull and the pump bracket, it becomes possible to ensure sufficient and long lasting sealing function of the connecting surfaces of the hull and the pump bracket under non-operating and operating conditions of the personal watercraft, thereby, preventing water leakage into the body of the watercraft and air drawn into the pump at the pump bracket mounting section.

Furthermore, continuous sealant recess in the connecting surface of the pump bracket facilitates the pump mounting operation, because the non-solid sealant is effectively distributed in the sealant recess after the application to the connecting surface of the pump bracket. Quicker and uniform application of the non-solid sealant also facilitates the mounting operation.

Threaded holes for screwing bolts therein to secure the pump bracket to the vertical wall, and a through hole for retaining a holder for passing an operation cable and for retaining a joint member for passing a bilge pipe or a cooling pipe and others which pass through the connecting surfaces are suitably arranged and are surrounded by the sealant recess. Therefore, the non-solid sealant is also accommodated around the holder and joint member which penetrate the connecting surface of the pump bracket, enhancing the water sealing property for the hole sections through which each of these members penetrate the vertical wall in the hull, and thereby also enhancing air and water tightness of these portions.

These objects, features and advantages of the present invention will become more apparent to those skilled in the art from the following description with reference to the accompanying drawings.

DESCRIPTION OF THE PREFERRED EMBODIMENT

An embodiment of the present invention will be explained below with reference to the drawings.

Figure 1:
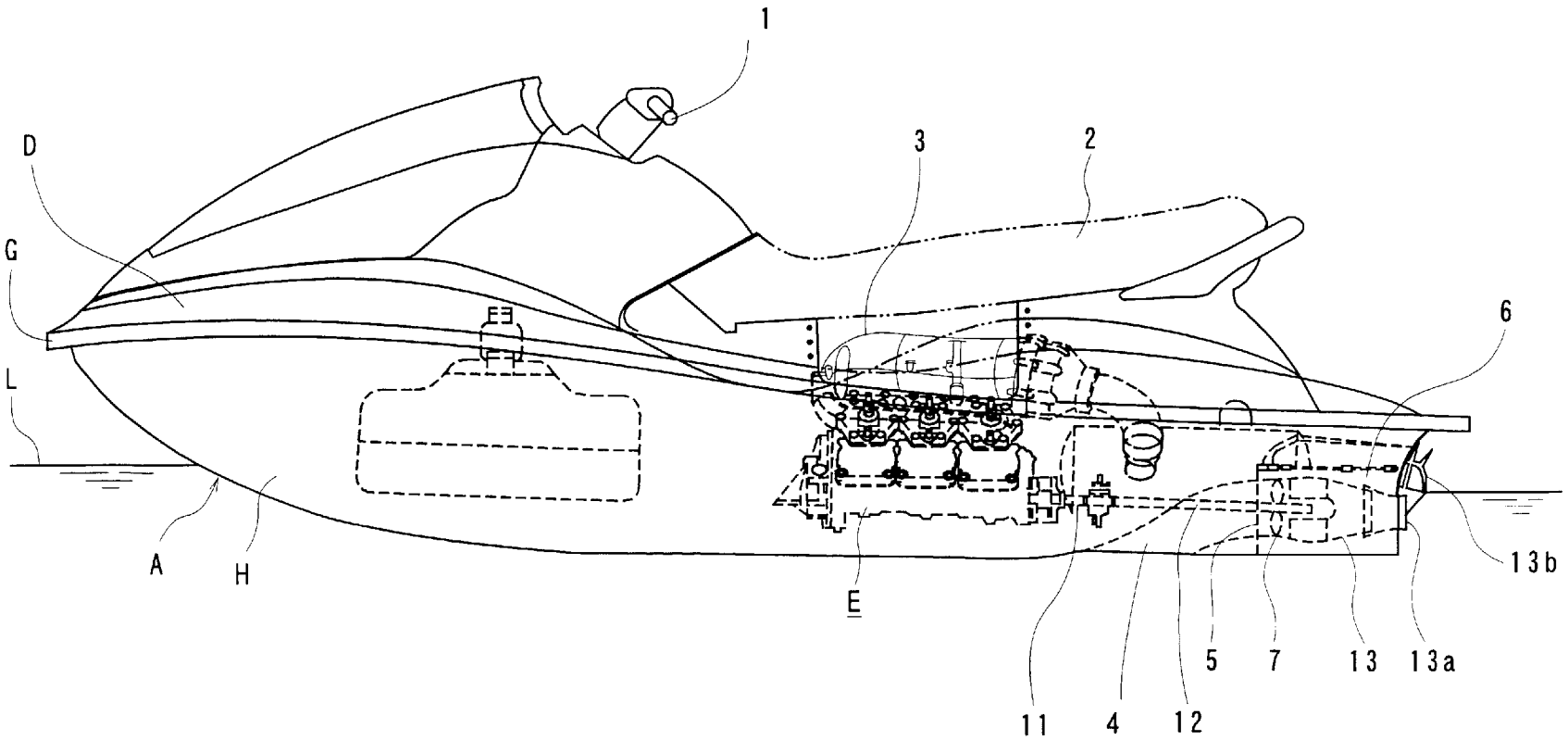
FIG. 1 is a side view of the personal watercraft showing an embodiment of the present invention.
Figure 2:
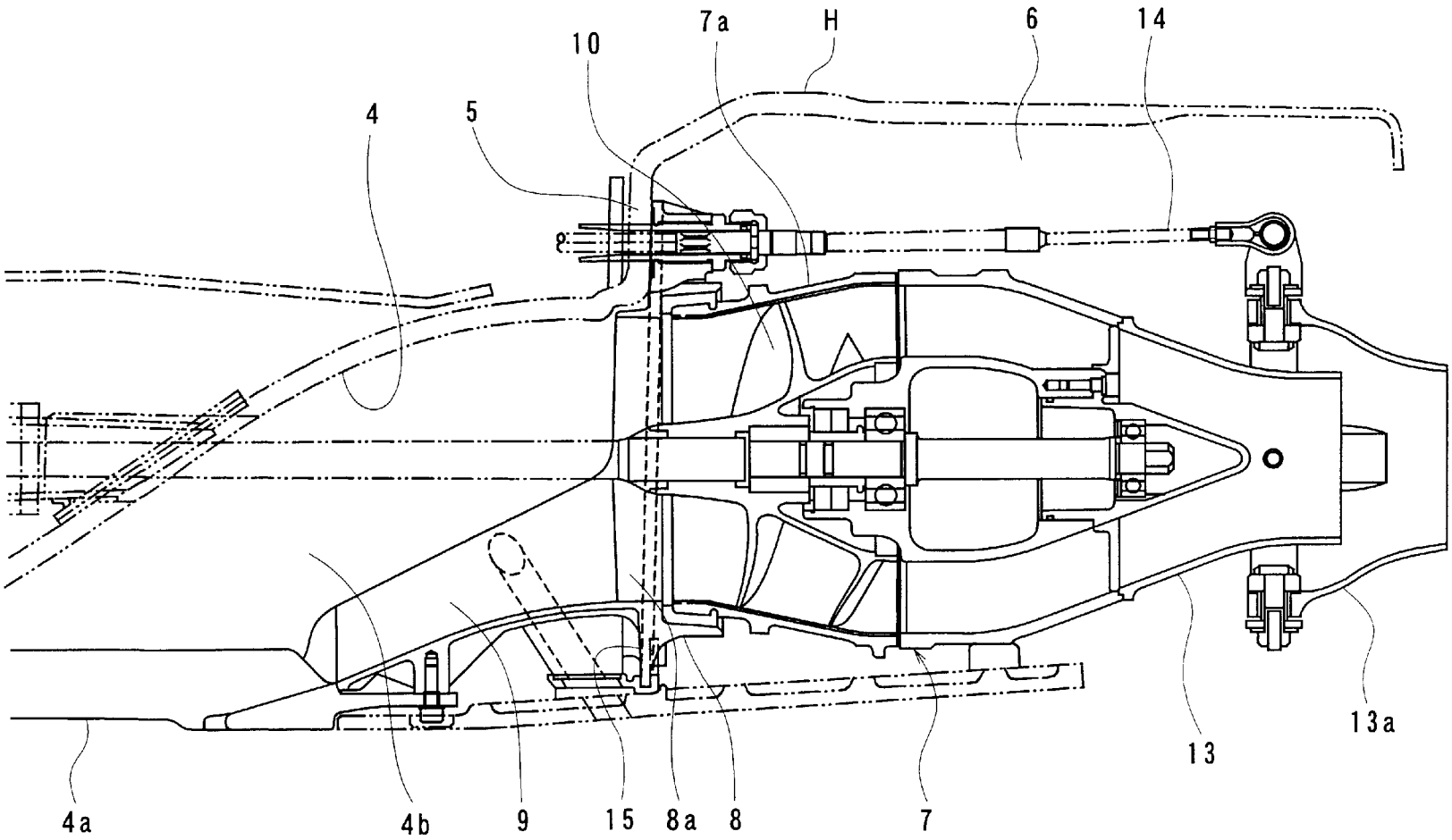
FIG. 2 is a vertical sectional view of a water jet pump, showing an embodiment of the present invention.

FIG. 1 is a side view of the entire personal watercraft showing an embodiment of the present invention. FIG. 2 is a vertical sectional view of the water jet pump.

In FIGS. 1 and 2, a body A of the personal watercraft comprises a hull H constituting the lower portion of the body, and a deck D covering the upper portion of the hull H, both made of plastic material. The hull H and deck D are connected along the entire peripheries to form a hollow shell structure. In the illustrated embodiment, the hull H and the deck D are connected with a so called gunnel line G positioned above the water level L.

A steering handle 1 is provided in the central upper section of the deck D. A drivers seat 2 is disposed to the rear of the handle 1 along the longitudinal direction of the body A. An engine E is mounted beneath the seat 2 in a space 3 enclosed by the hull H and deck D.

A water intake duct 4 extends diagonally upward and rearward from the bottom in the center rear portion of the hull H. A vertical wall 5 is formed on the rear end of the duct 4 forming a pump mounting space 6 to the rear of the vertical wall 5.

As shown in FIG. 2, a water jet pump 7 is mounted in the pump mounting space 6 through a pump bracket 8 fixed to the vertical wall 5 formed in the hull H. In this structure, an inlet of a pump casing 7*a* of the water jet pump 7 is sealingly fitted with the pump bracket 8. The opening portion of the water intake duct 4 in the hull bottom is covered with a water intake lip 9 integrally formed with the lower portion of the pump bracket 8, defining an opening 4*a* in the bottom of the hull and a water intake duct 4*b*. Thus, the inlet of the pump casing 7*a* is connected to the intake duct 4*b* through an opening 8*a* formed in the pump bracket 8.

An impeller 10 is rotatably supported in the pump casing 7*a* to form the water jet pump 7. The impeller 10 of the water jet pump 7 is rotatably connected through a propeller shaft 12 to an output shaft 11 (see FIG. 1) projected rearward of the engine E. The water jet pump 7 creates a propelling force by transmitting the rotation of the engine E output shaft 11 through the propeller shaft 12 to the impeller 10 so that water taken in from the water intake 4*a* opening in the bottom of the watercraft is pressurized and accelerated in the pump, and is ejected through an ejecting nozzle 13 provided in the rear of the water jet pump 7 to propel the watercraft.

A steering nozzle 13*a* which rotates in the horizontal direction is provided in the rear of the ejecting nozzle 13. The steering nozzle 13*a* is connected to the handle 1 (see FIG. 1) through a steering cable 14, thus, by turning the handle 1 clockwise or counter-clockwise the steering nozzle 13*a* is rotated laterally, to steer the watercraft in the desired direction As shown in FIG. 1, a reversing deflector 13*b* which rotates vertically is provided in the rear of the steering nozzle 13*a*. The deflector 13*b* is connected through a deflector cable to a reversing lever (not shown) mounted to the deck D near the steering handle 1 to operate the deflector 13*b* for changing the direction of rearwardly ejected water from the ejecting nozzle 13*a* to propel the watercraft backward.

Figure 3:
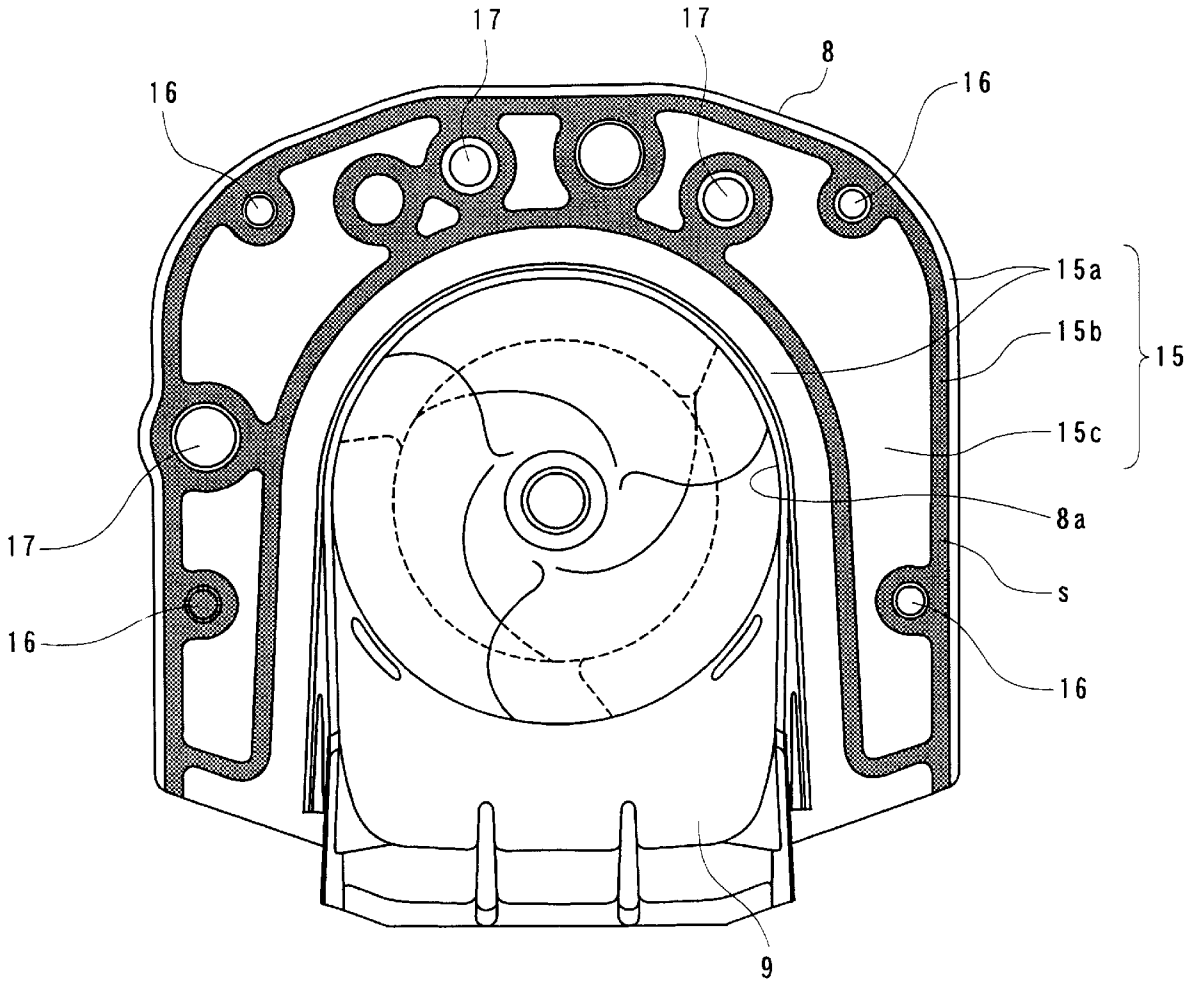
FIG. 3 is an enlarged front view of a pump bracket as viewed from the connecting surface showing an embodiment of the present invention.
Figure 4:
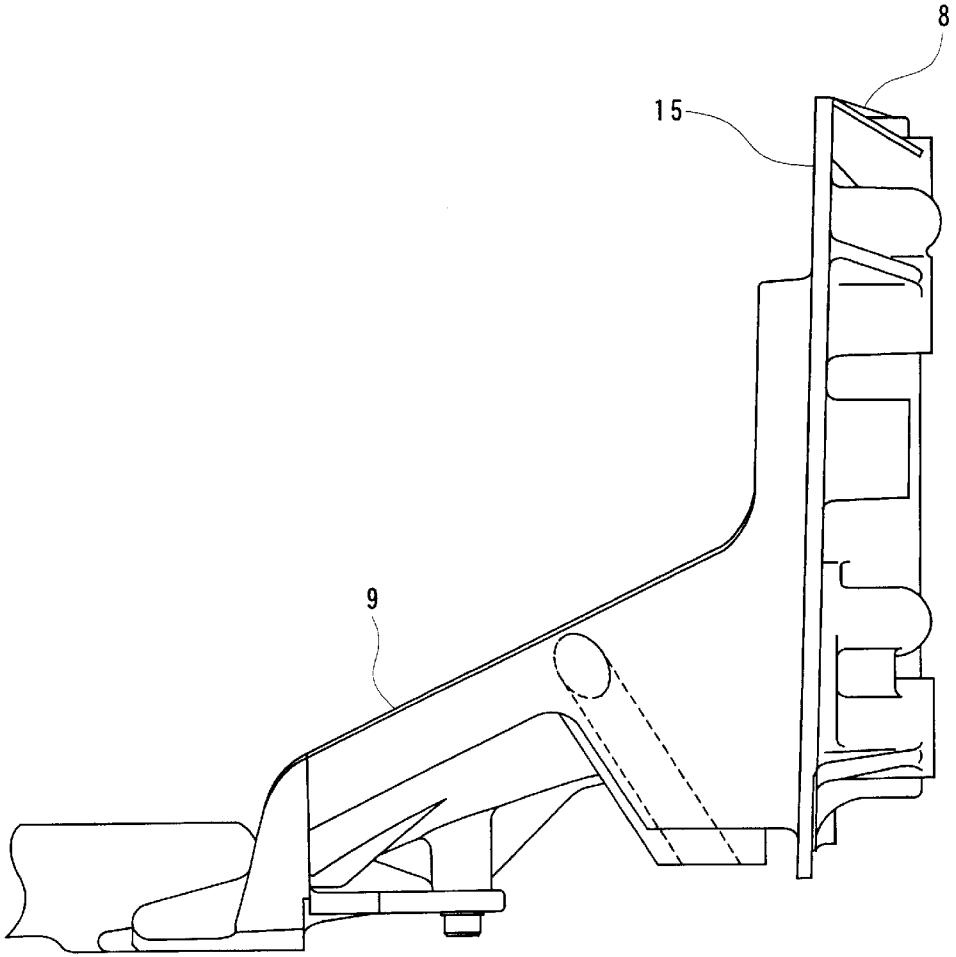
FIG. 4 is an enlarged side view of the pump bracket showing an embodiment of the invention.
Figure 5:
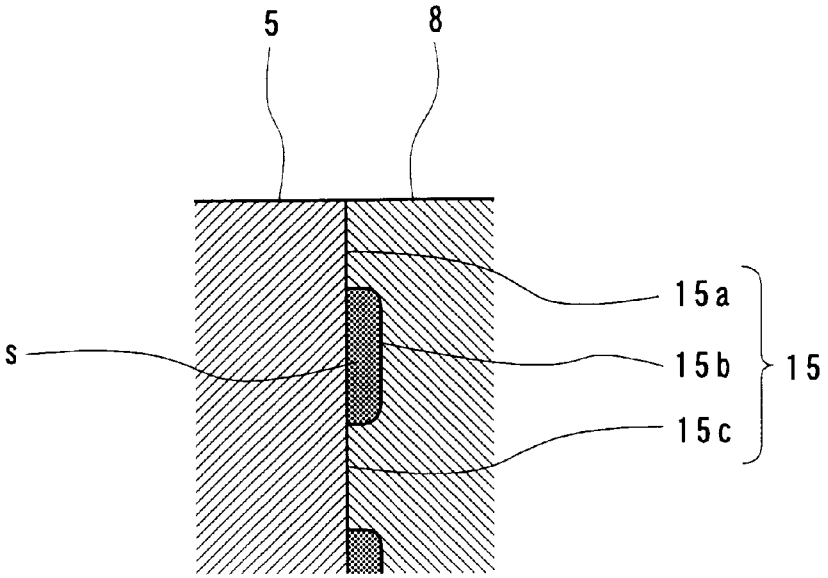
FIG. 5 is an enlarged sectional view of a portion of the connecting surface of an embodiment of the invention.

Turning to a more detailed illustration and description of the pump bracket 8, FIG. 3 is an enlarged front view of the pump bracket as viewed from the connecting surface side, FIG. 4 is an enlarged side view of the pump bracket; and FIG. 5 is an enlarged sectional view of a portion of the connecting surface.

In FIGS. 3 and 4, the pump bracket 8 has a connecting surface 15 to be connected to the surface of the vertical wall 5 (see FIGS. 1 and 2) formed in the hull H. As shown in FIG. 3, the connecting surface 15 of the pump bracket 8 has an inverted U-shape as viewed from the front, the upper half of an opening 8*a* of the pump bracket 8 is formed by the inner peripheral edge of the connecting surface 15, and the lower half of the opening 8*a* is formed by an upper surface of the water intake lip 9 formed integrally with the lower portion of the pump bracket 8 and projected forward.

A sealant recess 15*b* is formed in the connecting surface 15 of the pump bracket 8 for accommodating a non-solid sealant S, leaving a peripheral connecting surface 15*a* of a suitable width along the periphery of the connecting surface 15 with the sealant recess 15*b* intermediate the peripheral connecting surface 15*a*, and an inner connecting surface 15*c* surrounded by the sealant recess 15*b*. The sealant recess 15*b* also surrounds threaded holes 16 and through holes 17 provided in the connecting surface 15 of the pump bracket 8, such that the entire sealant recess 15*b* is formed continuously.

The threaded holes 16 are for screwing bolts therein to secure the pump bracket 8 to the vertical wall 5 formed in the hull H (see FIGS. 1 and 2). The through holes 17 are used to retain holders which pass operation cables, and also to retain joint members which pass a bilge pipe, a cooling water pipe and the like. In this embodiment, both the steering cable 14 and the deflector cable pass through the connecting surface 15 of the pump bracket 8. The diameter and retaining manners of holders 17 may vary from one another, however, the same reference number is used in the drawings.

In practice, a silicon gel sealant is used as the non-solid sealant S. Before the mounting of the pump bracket 8, the sealant S is applied to the entire connecting surface 15 of the pump bracket 8 to make the sealant S settle in the sealant recess 15*b*, then, the connecting surface 15 of the pump bracket 8 is secured to the surface of the vertical wall 5 of the hull H. The sealant S is distributed in the entire length of the sealant recess 15*b* as shown in FIG. 5, thereby maintaining a reliable sealing property over a long period of time.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A mounting structure for a water jet pump of a personal watercraft having a hull and a water intake duct, comprising:

a vertical wall formed in the hull at the rear end of the water intake duct to form a pump mounting space;

a pump bracket fitted with an inlet of the water jet pump mounted on the bottom of the watercraft, said pump bracket having a connecting surface to be connected to the vertical wall, said connecting surface having a sealant recess formed intermediate a peripheral connecting surface along the periphery of the connecting surface; and a non-solid sealant within said sealant recess for maintaining a reliable air and water seal between the connecting surface and the vertical wall.

2. The mounting structure for a water jet pump of a personal watercraft according to claim 1, wherein said sealant recess is entirely formed continuous in the connecting surface of said pump bracket.

3. The mounting structure for a water jet pump of a personal watercraft according to claim 1, wherein said sealant recess surrounds threaded holes and through holes formed in the connecting surface of said pump bracket.

4. A mounting structure for a water jet pump of a personal watercraft having a hull and a water intake duct, comprising:

a vertical wall formed in the hull at the rear end of the water intake duct to form a pump mounting space;

a pump bracket fitted with an inlet of the water jet pump mounted on the bottom of the watercraft, said pump bracket having a connecting surface to be connected to the vertical wall, said connecting surface having a sealant recess formed intermediate a peripheral connecting surface along the periphery of the connecting surface; and silicon gel sealant within said sealant recess for maintaining a reliable air and water seal between the connecting surface and the vertical wall.

* * * * *